US005913311A

United States Patent [19]

Ito et al.

[11] Patent Number: 5,913,311

[45] Date of Patent: Jun. 22, 1999

[54] CIGARETTE FILTER AND FILTER MATERIAL THEREFOR

[75] Inventors: Katsutaka Ito; Tsuruyoshi Matsumoto, both of Toyama; Atsushi Tokida, Yokohama; Tetsuro Shibata, Yokohama; Yoichiro Yamashita, Yokohama, all of Japan

[73] Assignees: Mitsubishi Rayon Co., Ltd.; Japan Tobacco Inc., both of Tokyo, Japan

[21] Appl. No.: 08/833,055

[22] Filed: Apr. 3, 1997

Related U.S. Application Data

[63] Continuation of application No. PCT/JP96/02178, Aug. 2, 1996.

[30] Foreign Application Priority Data

Aug. 4, 1995 [JP] Japan ..... 7-218300

[51] Int. Cl.[6] ..... A24D 3/04; A24D 3/02

[52] U.S. Cl. ..... 131/345; 131/332; 131/341; 131/342; 131/344; 264/148; 493/39; 493/47

[58] Field of Search ..... 131/332, 341, 131/342, 343, 344, 345; 264/148; 493/39, 47

[56] References Cited

U.S. PATENT DOCUMENTS

| | | | |
|---|---|---|---|
| 3,173,427 | 3/1965 | Tamblyn et al. . | |
| 3,227,791 | 1/1966 | Kiefer et al. . | |
| 3,476,120 | 11/1969 | Kiefer et al. | 131/267 |
| 4,752,348 | 6/1988 | Bryant et al. | 156/201 |
| 5,052,415 | 10/1991 | Henning et al. | 131/331 |
| 5,446,140 | 8/1995 | Maheras et al. | 536/123 |
| 5,453,144 | 9/1995 | Kauffman et al. | 156/213 |
| 5,523,036 | 6/1996 | Luke et al. | 264/45.3 |

FOREIGN PATENT DOCUMENTS

| | | |
|---|---|---|
| 608 047 | 1/1994 | European Pat. Off. . |
| 59-227289 | 12/1984 | Japan . |
| 60-98978 | 6/1985 | Japan . |
| 4-126817 | 4/1992 | Japan . |
| 5-505106 | 8/1993 | Japan . |
| 6-49275 | 2/1994 | Japan . |
| 6-146109 | 5/1994 | Japan . |
| 7-500385 | 1/1995 | Japan . |
| 7-76632 | 3/1995 | Japan . |
| 7-99959 | 4/1995 | Japan . |
| 91/12737 | 9/1991 | WIPO . |
| WO 91/12737 | 9/1991 | WIPO . |
| WO 93/07771 | 4/1993 | WIPO . |
| 94/16581 | 8/1994 | WIPO . |

*Primary Examiner*—Stanley S. Silverman
*Assistant Examiner*—Steven B. Leavitt
*Attorney, Agent, or Firm*—Pillsbury Madison & Sutro LLP

[57] ABSTRACT

A filter material comprises a cellulose acetate fiber tow containing 5–50% by weight of a water soluble material and/or a water dispersible material which are soluble in a solvent which dissolves cellulose acetate and which are not compatible with cellulose acetate. Due to the inclusion of the above-mentioned water soluble material and/or water dispersible material in the cellulose acetate fiber, in the presence of moisture, the fiber surface becomes porous by the elution of this water soluble material and/or water dispersible material from the fiber, and the surface area of the fiber is increased. Consequently, the shape of the cellulose acetate fiber tow is easily broken down, and the decomposability of the fiber by microorganisms and the like is increased. When a cigarette filter is made using this type of filter material, a cigarette filter is obtained which has easy decomposability in the natural environment and particularly in water, in atmospheres which contain large amounts of moisture, and the like.

12 Claims, 3 Drawing Sheets

CIGARETTE FILTER AND FILTER MATERIAL THEREFOR

This is a Continuation of: International Appln. No. PCT/JP96/02178 filed Aug. 2, 1996 which designated the U.S.

FIELD OF THE INVENTION

The present invention relates to a filter material which is easily decomposed, and to a cigarette filter which uses this filter material.

BACKGROUND OF THE INVENTION

Conventionally, cigarette filters are mostly manufactured from tows of cellulose ester fibers. From within these, since cellulose acetate fiber tows can maintain the rod shape in which they are deposited using triacetin which is a solvent thereof, it is possible to process filters easily, and they have the advantage of being usable in paper rolling cigarette manufacturing machines of high operating speeds.

After smoking, as cigarette stubs, filters are generally withdrawn by means of disposal in ash trays, or refuse bins, however, depending on the situation, by being thrown away, they can be left in natural environments, such as fields and mountains, rivers, lakes, and seas, and on roadways.

However, after smoking, the filter portion of the cigarette stub maintains a rod-like shape and this shape does not break down, in addition, since the tipping paper of the filter portion is hard to peel off, and the decomposition of the cellulose acetate fiber itself which is used in the filter is slow, and the like, it is difficult for the shape of the filter portion of the cigarette stubs in the natural environment to break down. Consequently, the leaving of these types of cigarette filters in the natural environment is a cause of the problem of environmental pollution, and this is also becoming a societal problem.

With regard to this type of problem, Japanese Patent Application, First Publication, No. Hei 6-49275 proposes a method of obtaining cellulose acetate which is superior in its decomposition properties by means of manufacturing cellulose acetate using sulfuric acid catalyst, and wherein the ratio of the amount (a) of sulfuric acid which remains in the cellulose acetate to the amount (b) of alkaline (earth type) metals contained in the cellulose acetate, (b)/(a), is 0.1–1.

In addition, in order to raise the biodegradability of cellulose acetate fiber, the inclusion of specific chemical compounds in the cellulose acetate fiber has been proposed. As this type of chemical compound, for example, nitrogen containing compounds are proposed in Japanese Patent Application, First Publication, No. Hei 7-99959, starch compounds are proposed in PCT Application, Japanese Publication, No. Hei 7-500385, and starch acetates are proposed in Japanese Patent Application, First Publication, No. Hei 6-329832. However, there is the problem that it is difficult to mix these compounds with cellulose acetate.

In addition, methods of coating or impregnating cellulose acetate fibers which are used in cigarette filters with various plasticizing agents are already known. For example, methods for impregnation with dicarboxylic acid, polycarboxylic acid and their anhydrides, and propionic acid polyethylene glycol, triethyleneglycol diacetate, and the like are disclosed in Japanese Patent Application, First Publication, No. Hei 2-39873; methods for impregnation with glycerin compounds are disclosed in PCT Application, Japanese Publication, No. Sho 63-500422; methods for impregnation with diacetate of polyethylene glycol are disclosed in Japanese Patent Application, First Publication, No. Sho 60-98978; methods for impregnation with polyalkylene glycol are disclosed in U.S. Pat. No. 4,752,348; methods for coating with fatty acid glycerin esters are disclosed in Japanese Patent Application, First Publication, No. Sho 59-227289; methods for coating with polyalkylene oxide are disclosed in U.S. Pat. No. 5,453,144, and methods for impregnation with lower fatty acid esters of multivalent alcohols, polyethylene glycol, and the like are disclosed in Japanese Patent Application, First Publication, No. Hei 7-76632.

However, in these methods, the function of the plasticizing agents is mainly to form a three dimensional network structure by the mutual bonding of the fibers by dissolving the surface of the cellulose acetate fibers, and while making a filter form which can be maintained, a suitable hardness is given to the filter. That is to say, in the above methods, the coating and impregnation of the cellulose acetate fiber with plasticizing agents was not for the purpose of the decomposition of fibers, rather it was for the purpose of controlling the decomposition of the fibers so as to make it possible to stably maintain the shape of the filter for a long period.

In addition, since the plasticizing agent coating or impregnating the surface of the fiber comes into direct contact with the cigarette smoke, it effects the smoking flavor. Consequently, the amount of the plasticizing agent used is usually 3–10% by weight since the quality of the filter is degraded by the occurrence of excessive dissolution and fusion of the cellulose acetate fibers when the amount is too great.

Furthermore, outside of the field of cigarette filters, for example, Japanese Patent Application, First Publication, No. Hei 4-126817, and Japanese Patent Application, First Publication, No. Hei 6-146109 propose cellulose acetate fibers which have improved deep dyeing properties by the addition of polypropylene glycol, polyethylene glycol and the like to cellulose acetate fibers. However, since these proposals are both related to cellulose acetate fibers for use as clothing fibers, they teach nothing at all about increasing the decomposability of filter materials or, specifically, cigarette filters.

Objects of the present invention are to increase the decomposability of cellulose acetate fibers in the natural environment, and to make the break down of the shape of the fibers of filter materials and the shape of cigarette filters easier.

DISCLOSURE OF THE INVENTION

The filter material of the present invention comprises a cellulose acetate fiber tow containing 5–50% by weight of a water-dispersible material and/or a water soluble substance which are soluble in a solvent which dissolves cellulose acetate, and which are not compatible with cellulose acetate.

Because the above mentioned water soluble substance and/or water dispersible substance is included and left in the cellulose acetate fiber tow, when in the presence of water, the surface of the fibers becomes porous and the surface area of the fibers is increased as the water soluble material and/or water dispersible material are eluted out of the fibers. Consequently, the shape of the cellulose acetate fiber tow is easily broken down, and decomposability of the fiber by microorganisms is increased. In addition, since the above-mentioned water-soluble material and water disposable material are soluble in solvents which dissolve cellulose acetate, suitable thread making properties are obtained.

If this type of fiber material is used to make a cigarette filter, a cigarette filter can be obtained which is easily decomposed in natural environments, and, in particular, in atmospheres which contain large amounts of moisture, within water, and the like.

BEST MODE FOR CARRYING OUT THE INVENTION

Figure 1:
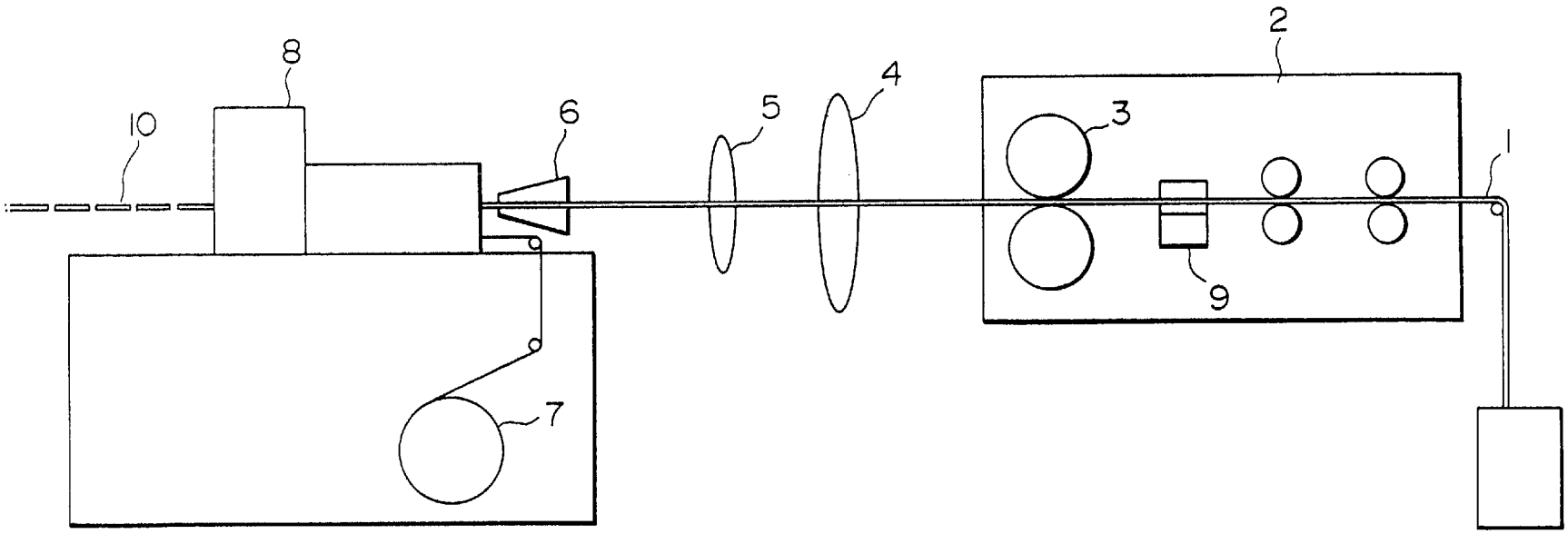
FIG. 1 is an outline diagram showing an example of a cigarette filter plug manufacturing device.

In the present invention, the filter material comprises a tow of cellulose acetate fiber. The cellulose acetate fiber which makes up the tow can be optionally acetylated, for example, a cellulose acetate fiber having a degree of acetylation of 48.8% or greater and less than 56.2%, a cellulose triacetate fiber having a degree of acetylation of 56.2% or greater, and the like can be used. From the view point of smoking flavor, a cellulose acetate having a degree of acetylation of 48.8%–56.2% is preferably used.

In addition, the fiber shape of the cellulose acetate fiber may be either staple or filament, however, as the cellulose acetate fiber which makes up the cigarette filter of the present invention, one which has the form which is called a fiber tow is preferable, and the total fineness of the tow can be optional. For example, a band shaped fiber tow in which 3,000–500,000 fibers of 1–10 denier are bundled together, and which has been given 10–50 crimps per 25 mm of length is preferable. Furthermore, in order to increase filtering efficiency as a cigarette filter, it is possible to increase the surface area by increasing the fineness, and in this situation, extremely fine fibers of 0.5–1 denier are preferable.

Furthermore, the cross-sectional shape of a single fiber can be round, square, or the like, and is not particularly limited, however, from the point of view of filtering efficiency as a cigarette filter, a multi-leaf like cross-section shape is preferable, and amongst these, from the point of view of the stability of the manufacturing process, a Y-like cross-sectional shape is preferably used.

In the present invention, the cellulose acetate fibers which make up the tow contain a water-soluble material which is soluble in a solvent which dissolves cellulose acetate and not compatible with cellulose acetate fibers and/or a water dispersible material which is not compatible with cellulose acetate fibers. This so called water dispersible material is a material which scatters in minute particles in water by means of transparent dispersion or emulsifying dispersion, and, specifically, for which the hydrophile-lypophile balance (HLB) is 2–18, and preferably is 3–18.

It is necessary for this water-soluble material and this water dispersible material to be soluble in a solvent such as acetone, a methylene chloride/methanol solvent mixture, and the like which are solvents which dissolve cellulose acetate. The reason for this is that these solvents are used as spinning solvents when spinning cellulose acetate fibers, and if materials which are insoluble in or which are difficult to dissolve in these spinning solvents are introduced into the spinning solution, the ability to pass through the processes in fiber manufacturing is reduced, and the properties of the fibers are reduced.

In addition, it is necessary for the above-mentioned water soluble material and water dispersible material to be not compatible with cellulose acetate. The reason for this is that these materials must be able to be easily separated from the fiber polymer in order to increase the decomposability of the cellulose acetate fibers.

Furthermore, since the above-mentioned water soluble material and water dispersible material are more easily eluted out from the fiber polymer in the presence of water, these materials cause the cellulose acetate fiber to decompose well and the shape to breakdown. In addition, it is preferable for the above-mentioned water soluble material and water dispersible material to have higher decomposability than cellulose acetate fiber.

As this water soluble material, hydroxyalkyl cellulose, polyalkylene glycol, methyl cellulose, polyvinyl pyrrolidone, and the like can be mentioned. In addition, as the above-mentioned water dispersible material, glycerin fatty acid ester, alkylene glycol fatty acid ester, sorbitan fatty acid ester, sucrose fatty acid ester, lecithin, and the like can be mentioned.

More specifically, for example, as the hydroxyalkyl cellulose, hydroxypropyl cellulose and hydroxyethyl cellulose can be mentioned; as the polyalkylene glycol, polyethylene glycol can be mentioned; as the glycerin fatty acid ester, glycerin oleocytrate can be mentioned; as the alkylene glycol fatty acid ester, propylene glycol monooleate can be mentioned; as the sorbitan fatty acid ester, polyethylene sorbitan monooleate and polyethylene sorbitan tristearate can be mentioned; and as the sucrose fatty acid ester, sucrose and solidified emulsified fatty acid ester and the like can be mentioned.

In addition, the water soluble material and the water dispersible material which are used in the present invention are not limited to one type, but can also be mixtures of two or more types.

In the present invention, the content of water soluble material and/or water dispersible material with regard to the cellulose acetate is preferably 5–50% by weight. When this content exceeds 50% by weight, it becomes difficult to obtain the fiber by means of spinning, and when the content is less than 5% by weight, the effect of promoting the decomposition of the cellulose acetate fiber cannot be obtained.

In the filter material of the present invention, since the cellulose acetate fiber contains the above-mentioned water soluble material and/or water dispersible material, in the presence of water such as in humid atmospheres or in water, the water soluble material and or water dispersible material contained in the fiber are eluted out of the fiber. Due to this, the surface of the fiber is made porous and the surface area of the fiber is increased, and therefore the shape is easily broken down, and the decomposability of the cellulose acetate fiber by means of microorganisms is increased.

In addition, since the added water soluble material and/or water dispersible material are soluble in solvents which dissolve cellulose acetate, good thread manufacturing properties are obtained.

Cellulose acetate fibers are not just used in filter tows for use in cigarette filters, they are used in many products such as weaving thread for manufacturing textiles, and many modifiers and modified methods have been proposed, however, up until now, the modifiers and modified methods which have been known have not obtained results like the improvements in the decomposability of cellulose acetate fiber as in the present invention.

More specifically, Japanese Patent Application, First Publication, No. Hei 2-138958 discloses a cigarette filter in which creatinine and glycodiamidine have been added to the filter in order to prevent the smell of the acetic acid odor arising from the cigarette filter. These compounds, the purpose of which is the control of the acetic acid odor, are solids which are difficult to dissolve in the spinning solvent for cellulose acetate, and are added in minute amounts to the outside of the fibers; they cannot be expected to have effects which promote the decomposition of the fibers.

Japanese Patent Application, First Publication 59-105067 discloses lower fatty acid esters of 2-methyl-1,3-propanediol as a cellulose acetate fiber bonding agent. This compound is a plasticizing agent for cellulose acetate fiber, it dissolves the surface of the fiber, the fibers become mutually bonded forming a three dimensional network structure, and the filter shape is maintained, this is its function, and there are no effects which promote the decomposition of the fiber. In addition, in this modified method, the amount of plasticizing agent for application to or impregnation of the outside of the fiber is usually 3–10% by weight. When this application amount or impregnation amount is increased, excessive dissolution and fusion of the cellulose acetate fibers arises and the quality of the filter product is reduced.

Japanese Patent Application, First Application, No. Hei 7-99959 discloses a manufacturing method for a filter tow characterized by containing, within or on the surface of the cellulose acetate fiber, a nitrogen containing compound which is degraded by basic decomposing substances due to microorganisms, and which is, in particular, ammonia, a basic compound having 1 or 2 or more NH groups and/or a basic compound having 1 or 2 or more $NH_2$ groups. The amounts of these chemical compounds introduced into the fiber are small at 5% by weight or less since they are difficult to dissolve in the spinning solvent for cellulose acetate. In addition, even when these chemical compounds are added to the surface of the fibers, these chemical compounds come into direct contact with the cigarette smoke, therefore, the amount added is limited due to the effect on smoking flavor, and effects like increasing the decomposability of the fiber, which is an object of the present invention, cannot be obtained.

Japanese Patent Application, First Publication, Hei 7-500385 discloses a manufacturing method for a cellulose acetate fiber bundle characterized by containing a water soluble chemical compound which is not poisonous and which is difficult to dissolve at 0.1–5% by weight with regard to cellulose acetate, and the diameter of this chemical compound is at least 30% smaller than that of the fiber. As this type of chemical compound, disaccharides, trisaccharides, organic acids, a number of inorganic acids, starch, starch derivatives, and dextrin are given as examples, however, all of these compounds are difficult to dissolve in cellulose acetate spinning solvent, and it is difficult to obtain excellent thread manufacturing properties like those of the present invention.

In addition, in the past, attempts have been made to introduce various additives into the spinning solution. In general, cellulose acetate fiber is manufactured by means of dry spinning methods in which cellulose acetate solution (spinning solution) is discharged from a spinning nozzle, therefore, when additives which do not dissolve in the spinning solvent are introduced, the stability of the suspension state of the spinning solution and the stability of the spinning process are effected. Consequently, the quantity of additives added to the spinning solution is limited, for example, when titanium oxide is added to cellulose acetate fiber for cigarette filter use, the amount added is quite small at 1% by weight or less.

Japanese Patent Application, First Publication, No. Hei 6-329832 discloses a composition of cellulose acetate and starch acetate and a fiber which is prepared from that composition. Starch acetate is soluble in the spinning solvent for cellulose acetate, and a uniform spinning solution is formed, however, it is not soluble in water. This starch acetate is intended to give better dyeing properties, greater thread elongnation, and water ratio in the fiber, however, since it does not dissolve in water, it cannot be expected to improve the decomposability of the cellulose acetate fiber in way the present invention does.

The cellulose acetate fiber tow used in the filter material of the present invention is manufactured, for example, in the following way.

Firstly, a spinning solution having a cellulose acetate concentration of 15–35% by weight, and preferably 18–30% by weight is prepared by dissolving cellulose acetate starting material or cellulose acetate flakes in a single solvent such as methylene chloride, or acetone, or in a solvent mixture of methylene chloride and methanol. When preparing this spinning solution, a solution of the solvent for the cellulose acetate in which a water soluble material and/or a water dispersible material which are soluble in this solvent and which are not compatible with cellulose acetate have been dissolved; and a solution of the solvent for the cellulose acetate in which the cellulose acetate has been dissolved are mixed. Alternatively, the above-mentioned water soluble material and/or water dispersible material can be added and mixed directly to the solution of the solvent for cellulose acetate in which the cellulose acetate has been dissolved; then fixed dispersion or an agitation treatment can be conducted, and thereby, this water soluble material and/or water dispersible material are present in a dispersed manner in the spinning solution.

Here, the dispersion mixing method can be a method which uses a disperser. For example, when using a side type sand mill as a disperser, the disk rotation speed, bead diameter (0.8–1.0 mm diameter), bead filling ratio, the length of time within the container, and the like are suitably adjusted.

Cellulose acetate fibers are obtained by spinning by means of a dry spinning method in which the cellulose acetate spinning solution which contains the above-mentioned water soluble material and/or water dispersible material which has been obtained in the above way is supplied to a spinning nozzle device and discharged into a high temperature atmosphere. Moreover, in order to easily make a filter plug, the total fineness for the fiber bundle is suitably set. In addition, wet spinning, not dry spinning, can also be conducted.

Furthermore, when spinning, as above, it is suitable to spin a spinning solution which has been uniformly dispersed in that condition into fiber form; however, it is also possible to use a method in which a spinning solution to which a water soluble material and/or a water dispersible material have been added, and a spinning solution to which these materials have not been added to spin a composite sheathed type or a side by side type fiber (or the like) in such a way that a polymer containing at least the water soluble material and/or the water dispersible material is present on the fiber surface.

Next, a method for manufacturing a cigarette filter using a cellulose acetate fiber obtained in this way will be explained.

Generally, a cellulose acetate tow is opened in a cigarette filter plug making machine, impregnated with plasticizing agent, then molded into a fiber rod shape, formed into a filter plug by cutting to the necessary length, and then this filter plug is used to manufacture a cigarette filter. Here, the impregnation with the plasticizing agent is to cause the partial adhesion of the fibers to each other by dissolving a part of the fibers by means of the uniform application or impregnation of the fibers with the plasticizing agent.

In the following, a manufacture method for a cigarette filter plug is explained with reference to FIG. 1. FIG. 1 is an outline diagram showing an example of a filter plug making machine suitable for use with the present invention. In the Figure, reference mark 1 is a crimped tow of cellulose acetate fiber.

First, in opening device 2 which comprises a plasticizing agent impregnation section 9 and delivery rollers 3, the crimped tow 1 of cellulose acetate fiber is put into a uniformly opened condition, and uniformly impregnated with a plasticizing agent, preferably triacetin or the like, in the plasticizing agent impregnation section 9. After this, the cutaway shape of the opened fiber tow sheet is broadened into a circular arc shape by means of passage through first ring guide 4 and second ring guide 5. Next, while giving it a lifting thrust by means of airjet 6, it is formed into a rod shape with rolled paper 7, and cut to the desired length by cutter 8, thereby making filter plug 10.

Alternatively, a rod can also be formed by means of a plug rolling device the same as the device in FIG. 1 by using an unwoven sheet manufactured from short fibers made from cellulose acetate fiber tow which has been cut to 1–100 mm. In addition, after impregnation with the plasticizing agent in accordance with need, the opened fiber tow or unwoven sheet comprising short fibers can be made into a grooved processed sheet by pressure forming by means of a corrugated thermoforming device having a grooved thermal roll, and this sheet also can be formed into a rod.

Here, the plasticizing agent used when forming the filter plug should be one which can be applied to cellulose acetate fiber tow. Specifically, a polyol ester compound such as triacetin, 1,3-butylene glycol acetate, and the like can be used. The amount of plasticizing agent used is preferably 3–10% by weight with respect to the weight of the fiber tow.

When manufacturing cigarette filters using a filter plug obtained in this way, not only cigarette filters comprising only cellulose acetate fiber containing the above-mentioned water soluble material and/or water dispersible material, but other filter materials, for example a cellulose acetate fiber which does not contain the water soluble material or the water dispersible material, can be combined, and cigarette filters of every type of structure can be manufactured.

Figure 2:
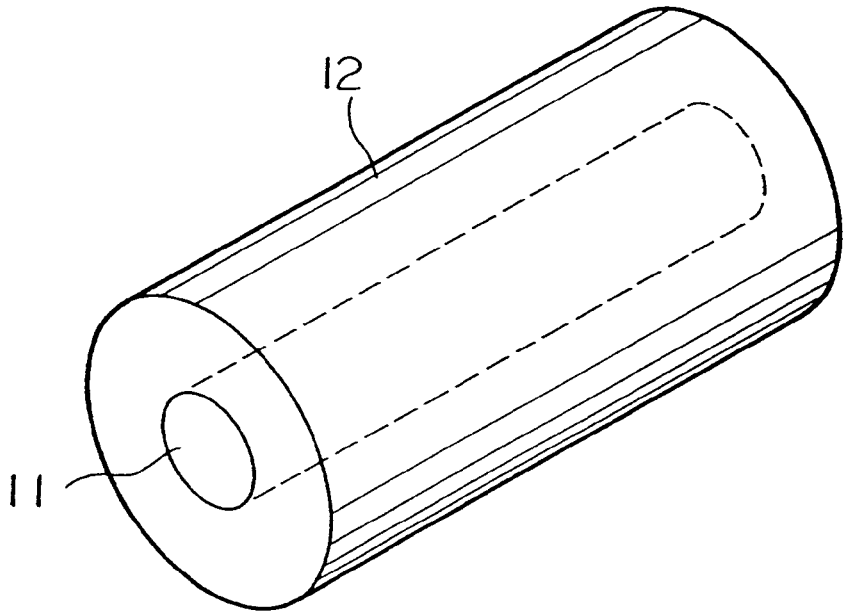
FIG. 2 is an incline view showing an example of a cigarette filter made using the filter material of the present invention.

For example, as shown in FIG. 2, it is possible to make a cigarette filter having a sheath core structure comprising a central core section 11 made from a first filter material and, surrounding that, a sheath section 12 made from a second filter material. In this situation, the cellulose acetate fiber of the present invention (hereinafter, this is also called the filter material of the present invention) which contains the water soluble material and/or the water dispersible material can be used in either of the core section 11 or in the sheath section 12, however, it is preferably used in the sheath section 12 which has a larger surface area exposed to the outer environment, and thereby the decomposability of the cigarette filter is increased.

Figure 3:
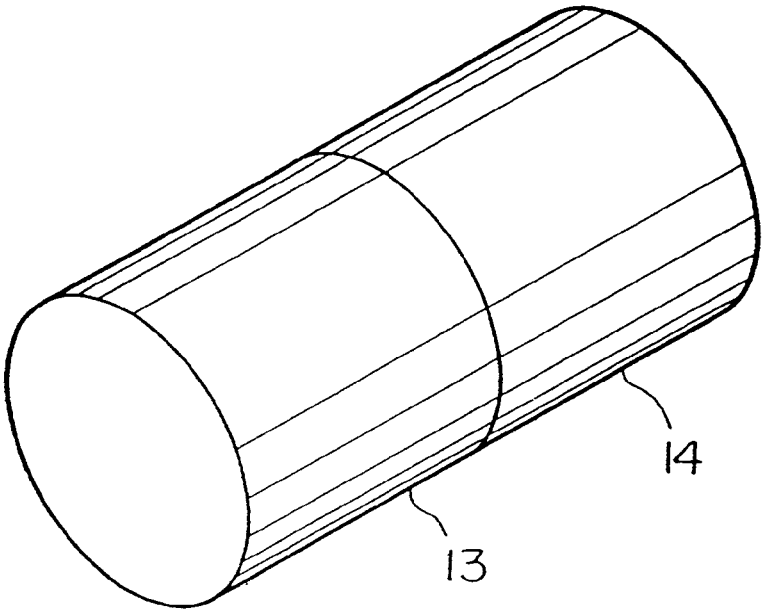
FIG. 3 is an incline view showing an example of a cigarette filter made using the filter material of the present invention.

In addition, as shown in FIG. 3, a dual structure cigarette filter can also be made in which the mouth piece 13 comprises a first filter material, and the section which is in contact with the cigarette leaf (leaf joining section) 14 comprises a second filter material. In this situation, the filter material of the present invention can be used in either of the mouth piece 13 or the leaf joining section 14, however, it is preferable to use it in the mouth piece 13 which is exposed to the external environment, and thereby increase the decomposability of the cigarette filter.

In addition, depending on the situation, as shown in FIGS. 4–9, a cigarette filter can also be made which has a structure in which a sheath core filter section 30 having a sheath core structure (core section 21 and sheath section 22) and a plain filter section 25 comprising a single material are joined longitudinally. In these Figures, reference numbers 23 and 26 indicate rolled paper, 24 indicates a ventilation aperture, and 57 indicates the tobacco leaf section.

Figure 4:
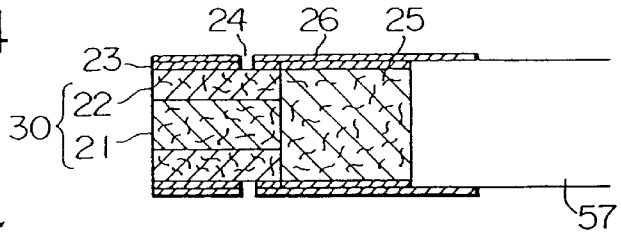
FIG. 4 is a cross section diagram showing an example of a cigarette filter made using the filter material of the present invention.

In the cigarette filter of FIG. 4, the mouth piece comprises sheath core filter 30, and the section connecting with tobacco leaf section 57 comprises plain filter section 25. In a cigarette filter having this structure, the filter material of the present invention can also be used in any of the core section 21, the sheath section 22, or the plain filter section 25; however, it is most preferably used in the sheath section 22, and next preferably used in core section 21, and, thereby, the decomposability of the cigarette filter can be effectively increased.

Figure 5:
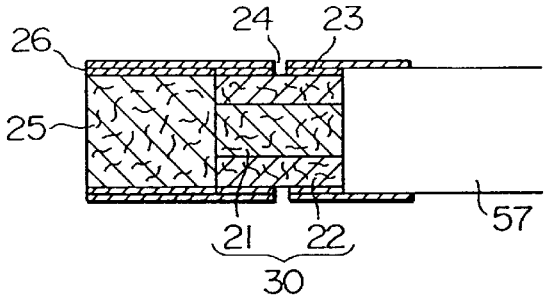
FIG. 5 is a cross section diagram showing an example of a cigarette filter made using the filter material of the present invention.

In the cigarette filter of FIG. 5, the mouth piece comprises plain filter section 25, and the section connecting with tobacco leaf section 57 comprises sheath core filter 30. In a cigarette filter having this structure, the filter material of the present invention can also be used in any of the core section 21, the sheath section 22, or the plain filter section 25; however, it is most preferably used in the plain filter section 25, and, thereby, the decomposability of the cigarette filter can be effectively increased.

Figure 6:
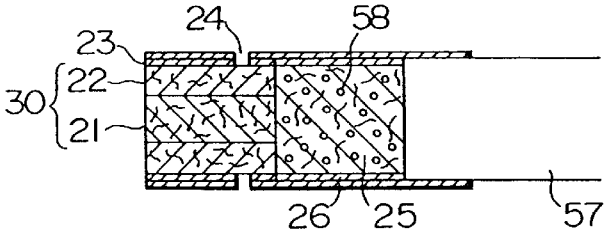
FIG. 6 is a cross section diagram showing an example of a cigarette filter made using the filter material of the present invention.

In the cigarette filter of FIG. 6, the mouth piece comprises sheath core filter 30, the section connecting with tobacco leaf section 57 comprises plain filter section 25, and, in addition, activated carbon 58 is added to plain filter section 25. In a cigarette filter having this structure, the filter material of the present invention can also be used in any of the core section 21, the sheath section 22, or the plain filter section 25; however, it is most preferably used in the sheath section 22, and next preferably used in core section 21, thereby, the decomposability of the cigarette filter can be effectively increased.

Figure 7:
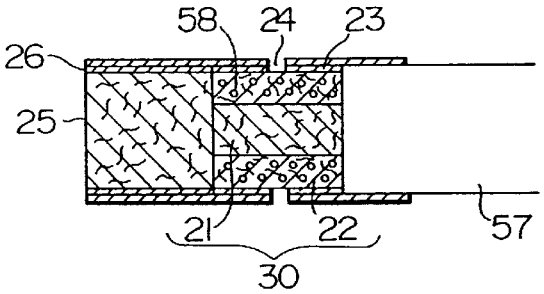
FIG. 7 is a cross section diagram showing an example of a cigarette filter made using the filter material of the present invention.

In the cigarette filter of FIG. 7, the mouth piece comprises plain filter section 25, the section connecting with tobacco leaf section 57 comprises sheath core filter 30, and, in addition, activated carbon 58 is added to sheath section 22.

Figure 8:
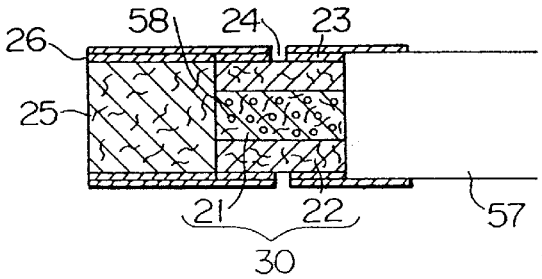
FIG. 8 is a cross section diagram showing an example of a cigarette filter made using the filter material of the present invention.

In the cigarette filter of FIG. 8, the mouth piece comprises plain filter section 25, the section connecting with tobacco leaf section 57 comprises sheath core 30, and, in addition, activated carbon 58 is added to core section 21.

Figure 9:
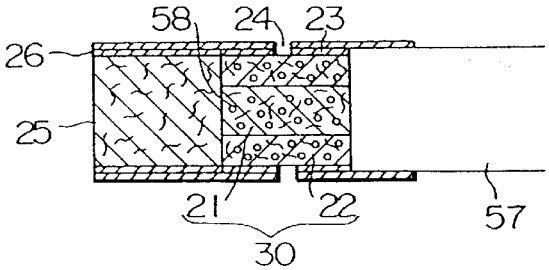
FIG. 9 is a cross section diagram showing an example of a cigarette filter made using the filter material of the present invention.

In the cigarette filter of FIG. 9, the mouth piece comprises plain filter section 25, the section connecting with tobacco leaf section 57 comprises sheath core section 30, and, in addition, activated carbon 58 is added to core section 21 and sheath section 22.

In the cigarette filters of the structures shown in these FIGS. 7–9, the filter material of the present invention can be used in any of the core section 21, the sheath section 22, and the plain filter section 25; however, preferably, it is used in the plain filter section 25, and thereby the decomposability of the cigarette filter is effectively increased. In addition, the cigarette filter is preferably structured in such a way as to have a suction resistance in the range of 100–200 mm $H_2O$ from the point of view of drawing ease, and filtering efficiency.

With regard to the cigarette filter made using the filter material of the present invention, Since the decomposability of the cellulose acetate fiber of the filter material in the presence of water is high, when it is left in the natural environment as a cigarette stub or the like, the form of the fiber of the filter material and the shape of the cigarette filter are easily broken down by means of moisture such as rain water. The decomposition of this cellulose acetate fiber and the break down of the shape of the cigarette filter are particularly remarkable when thrown into water.

In addition, it is also possible to make a cigarette filter by combining the filter material of the present invention and other filter material, thereby the decomposability of the whole filter can be increased and improvement in the decomposability of the portion made from other filter material can also be expected to be improved.

EXAMPLES

In the following, specific explanation is given by means of showing Examples of the present invention.

Reference Example

For the purpose of choosing a water soluble material or a water dispersible material which can be dissolved in a solvent which can dissolve cellulose acetate, and which are not compatible with cellulose acetate, solubility in water and acetone which is a solvent for spinning were examined for various compounds. The results are shown in Table 1 below. In the Table, the mark ○ indicates solubility at 20° C., the mark Δ indicates solubility at 65° C., and the mark X indicates insolubility.

In addition, the compounds which were soluble in acetone and water based on the results of Table 1, were tested to determine whether they were compatible with cellulose acetate. Those results are shown in Table 2 below. The judgment of non-compatibility with cellulose acetate was conducted by means of observing the phase separation of the compounds using a light microscope and an electron microscope for a film made by running an acetone solution of cellulose acetate containing the respective compound on a glass plate. In the Figure, the mark ○ indicates that phase separation was observed, the mark X indicates a uniform phase for which phase separation was not observed.

TABLE 1

| | Soluble in Acetone | | | Soluble in Water | |
|---|---|---|---|---|---|
| | Amount Added (% by weight) | | | Amount Added (% by weight) | |
| COMPOUND | 10 | 20 | 40 | 10 | 20 |
| hydroxypropyl cellulose (molecular weight: 10,000) | ○ | ○ | ○ | ○ | ○ |
| polyethylene glycol (molecular weight: 600) | ○ | ○ | ○ | ○ | ○ |
| sucrose fatty acid ester | ○ | ○ | Δ | ○ | ○ |
| glycerin oleo citrate | ○ | ○ | ○ | ○ | ○ |
| propylene glycol monooleate | ○ | ○ | ○ | ○ | ○ |
| triacetin | ○ | ○ | ○ | ○ | ○ |
| triethylene glycol diacetate | ○ | ○ | ○ | ○ | ○ |
| hexamethylenetetramine | X | X | X | ○ | ○ |
| urea | X | X | X | ○ | ○ |
| creatinine | X | X | X | ○ | ○ |
| β-lactoglobulin | X | X | X | ○ | ○ |
| starch | X | X | X | ○ | ○ |
| dextrin | X | X | X | ○ | ○ |

TABLE 2

| | Amount of Additive (% by weight) | | | |
|---|---|---|---|---|
| COMPOUND | 10 | 20 | 30 | 40 |
| hydroxypropyl cellulose (molecular weight: 10,000) | ○ | ○ | ○ | ○ |
| polyethylene glycol (molecular weight: 600) | ○ | ○ | ○ | ○ |
| sucrose fatty acid ester | ○ | ○ | ○ | ○ |
| glycerin oleo citrate | ○ | ○ | ○ | ○ |
| propyleneglycolmonooleate | ○ | ○ | ○ | ○ |
| triacetin | X | X | X | X |
| triethylene glycol diacetate | X | X | X | X |

Example 1

A spinning solution having a cellulose acetate concentration of 27.0% by weight was prepared by mixing a solution of hydroxypropyl cellulose having a molecular weight of 10,000 dissolved in acetone into a solution of cellulose acetate having an average degree of acetylation of 55.5% dissolved in acetone, in such a way that the amount of hydroxypropyl cellulose added was 20% by weight. A 65 denier/17 filament cellulose acetate fiber thread was obtained by dry spinning this spinning solution using a spinning nozzle having an hole number of 17 and an hole diameter of 36 $\mu$m. The strength and elongnation of the obtained thread, and the strength, elongnation, and the percentage weight loss after immersion in water for two weeks were measured. The results are shown in Table 3 below. The percentage weight loss was calculated from the weight of the fiber before and after immersion in water.

Comparative Example 1

A 65 denier/17 filament cellulose acetate fiber thread was obtained in the same way as in Example 1, with the exception that, in place of the spinning solution containing hydroxypropyl cellulose in Example 1, a spinning solution was used which had a cellulose acetate concentration of 28.85% by weight, which did not contain hydroxypropyl cellulose, and which was prepared by dissolving cellulose acetate having an average degree of acetylation of 55.5% in acetone. The strength and elongnation of the obtained thread, and the strength, elongnation and the percentage weight loss after immersion in water for two weeks were measured. The results are shown in Table 3 below.

TABLE 3

| | Example 1 | Comparative Example 1 |
|---|---|---|
| Strength (g/d) | 0.97 | 1.35 |
| Elongation (%) | 20.7 | 29.1 |
| Strength after immersion in water (g/d) | 1.04 | 1.27 |
| Elongation after immersion in water (%) | 25.7 | 29.1 |
| Weight loss (%) | 7.3 | 0.2 |

Example 2

A spinning solution having a cellulose acetate concentration of 27.0% by weight was prepared by mixing a solution of hydroxypropyl cellulose having a molecular weight of 10,000 dissolved in acetone into a solution of cellulose acetate having a average degree of acetylation of 55.5% dissolved in acetone, in such a way that the amount of hydroxypropyl cellulose added was 20% by weight. A cellulose acetate fiber tow having a total fineness of 40,000 denier and a single fiber fineness of 4 denier was obtained by a dry spinning method using this spinning solution. A tow for use in a cigarette filter was obtained by giving this tow a crimp by additionally passing it through a crimper. The strength of the obtained tow, and the strength and the percentage weight loss after immersion in water for two weeks were measured. These results are shown in Table 4 below.

Comparative Example 2

A tow for use in a cigarette filter was obtained in the same way as Example 2, with the exception that, in place of the spinning solution containing hydroxypropyl cellulose in Example 2, a spinning solution was used which had a cellulose acetate concentration of 28.85% by weight, which did not contain hydroxypropyl cellulose, and which was prepared by dissolving cellulose acetate having an average degree of acetylation of 55.5% in acetone. The strength of the obtained tow, and the strength and the percentage weight loss after immersion in water for two weeks were measured. These results are shown in Table 4 below.

TABLE 4

| | Example 2 | Comparative Example 1 |
|---|---|---|
| Strength (kg) | 10.8 | 13.2 |
| Strength after immersion in water (kg) | 11.1 | 12.5 |
| Weight loss (%) | 8.3 | 0.3 |

Example 3

A spinning solution having a cellulose acetate concentration of 27.0% by weight was prepared by mixing a solution of polyethylene glycol having a molecular weight of 600 was dissolved in acetone into a solution of cellulose acetate having a average degree of acetylation of 55.5% dissolved in acetone, in such a way that the amount of polyethylene glycol added was 20% by weight. A 65 denier/17 filament cellulose acetate fiber thread was obtained by dry spinning this spinning solution using a spinning nozzle having an hole number of 17 and an hole diameter of 36 $\mu$m. The strength and elongnation of the obtained thread, and the strength, elongnation and the percentage weight loss after immersion in water for two weeks were measured. The results are shown in Table 5 below.

TABLE 5

| | Example 3 |
|---|---|
| Strength (g/d) | 0.67 |
| Elongation (%) | 22.8 |
| Strength after immersion in water (g/d) | 1.19 |
| Elongation after immersion in water (%) | 21.9 |
| Weight loss (%) | 19.8 |

Example 4

A spinning solution having a cellulose acetate concentration of 27.0% by weight was prepared by mixing a solution of polyethylene glycol having a molecular weight of 1000 dissolved in acetone into a solution of cellulose acetate having an average degree of acetylation of 55.5% dissolved in acetone, in such a way that the amount of polyethylene glycol added was 20% by weight. A cellulose acetate fiber tow having a total fineness of 40,000 denier and a single fiber fineness of 4 denier was obtained by a dry spinning method using this spinning solution. A tow for use in a cigarette filter was obtained by giving this tow a crimp by additionally passing it through a crimper. The strength of the obtained tow, and the strength and the percentage weight loss after immersion in water for two weeks were measured. These results are shown in Table 6 below.

TABLE 6

| | Example 4 |
|---|---|
| Strength (kg) | 6.3 |
| Strength after immersion in water (kg) | 6.5 |
| Weight loss (%) | 19.9 |

Example 5

The cellulose acetate fiber threads obtained in the above-mentioned Example 1, Example 3, and Comparative Example 1 were respectively bundled at a fixed weight, collected in a polypropylene net having a fine mesh, and immersed in a water tank into which always fresh sea water flowed. After immersion in sea water for 2 months, the percentage of the weight loss for the respective fibers was measured. The results are shown in Table 7 below. The percentage of weight loss is calculated from the weight of the fiber before and after immersion in sea water.

TABLE 7

| | Example 1 | Example 3 | Comparative Example 1 |
|---|---|---|---|
| Weight loss (%) | 63.9 | 82.7 | 20.1 |

Industrial Applicability

The filter material of the present invention contains a water soluble material and/or a water dispersible material which are soluble in a solvent which dissolves cellulose acetate, and which are not compatible with cellulose acetate, therefore, in the presence of water, this water soluble material and/or water dispersible material elute out of the fiber. For this reason, the surface of the fiber becomes porous, and the surface area of the fiber is increased, therefore, the shape breaks down easily and the decomposability of the cellulose acetate fiber due to microorganisms and the like is increased.

This type of filter material is particularly good for cigarette filters, and, from the point of view of the natural environment and in particular in water or atmospheres which contain large amounts of moisture, cigarette filters which use the filter material of the present invention promote progress toward a condition which is easily decomposed by means of microorganisms and the easy breakdown of the shape of the cigarette filter, therefore they have good decomposabilty. Consequently, the filter material of the present invention and the cigarette filter which uses this filter material are good as countermeasures against environmental pollution.

We claim:

1. A biodegradable filter material comprising cellulose acetate fiber tow containing 5–50% by weight of a water soluble material and/or a water dispersible material which are soluble in a solvent which dissolves cellulose acetate, and which are not compatible with cellulose acetate, and said fiber tow has a weight loss after immersion in water of at least 7% by weight and a suction resistance in the range of 100–200 $mmH_2O$.

2. A cigarette filter comprising a filter material formed in a rod shape and wherein at least one part of said filter material is said filter material according to claim 1.

3. A cigarette filter comprising a core section comprising said filter material of claim 1, and a sheath section comprising a different filter material to that of said core section on an outer periphery of said core section.

4. A cigarette filter comprising a sheath section comprising said filter material of claim 1, and a core section comprising a different filter material to that of said sheath section to the inside of said sheath section.

5. A cigarette filter comprising a mouth piece comprising a first filter material formed in a rod shape; and a leaf joining section comprising a second filter material formed in a rod shape and joined longitudinally to said mouth piece, wherein one of said first filter material and second filter material comprises said filter material according to claim 1 and another comprises a different filter material.

6. A filter material according to claim 1 wherein a hydrophile-lypophile balance of said water dispersible material is 3–18.

7. A cigarette filter comprising a sheath core filter section having a core section comprising a first filter material and a sheath section surrounding said core section, comprising a second filter material; and a plain filter section comprising a third filter material joined longitudinally to said sheath core filter section, wherein at least one of said core section, sheath section, and plain filter section comprises said filter material according to claim 1.

8. A biodegradable filter material comprising cellulose acetate fiber tow containing 5–50% by weight of at least one material selected from the group consisting of hydroxyalkyl cellulose, methyl cellulose, polyvinyl pyrrolidone, glycerin fatty acid ester, alkylene glycol fatty acid ester, sorbitan fatty acid ester, sucrose fatty acid ester, and lecithin.

9. A method of manufacturing a environmentally decomposable cellulose acetate fiber tow cigarette filter that has a weight loss after immersion in water of at least 7% by weight and a suction resistance in the range of 100–200 $mmH_2O$ comprising:

adding to said fiber tow a water soluble material and/or a water dispersible material which is soluble in a solvent which dissolves cellulose acetate, and which is not compatible with cellulose acetate, such that the final amount of said water soluble material and/or water dispersible material in said filter is 5–50% by weight.

10. The method of claim 9, wherein said material is at least one material selected from the group consisting of hydroxyalkyl cellulose, methyl cellulose, polyvinyl pyrrolidone, glycerin fatty acid ester, alkylene glycol fatty acid ester, sorbitan fatty acid ester, sucrose fatty acid ester, and lecithin.

11. A biologically degradable filter material comprising:

a cellulose acetate fiber tow; and an effective amount of a water soluble material and/or a water dispersible material, which are soluble in a solvent which dissolves cellulose acetate, and which are not compatible with cellulose acetate, for causing said fiber tow to have a weight loss after immersion in water of at least 7% by weight and a suction resistance in the range of 100–200 $mmH_2O$.

12. The biologically degradable filter material of claim 11, wherein said effective amount is about 5–50% by weight.

* * * * *